United States Patent [19]

Paz-Pujalt

[11] Patent Number: 5,073,410

[45] Date of Patent: Dec. 17, 1991

[54] THIN FILMS OF METAL PHOSPHATES AND THE METHOD OF THEIR FORMATION

[75] Inventor: Gustavo R. Paz-Pujalt, Rochester, N.Y.

[73] Assignee: Eastman Kodak Company, Rochester, N.Y.

[21] Appl. No.: 421,889

[22] Filed: Oct. 16, 1989

[51] Int. Cl.[5] ..... B05D 3/02

[52] U.S. Cl. ..... 427/226; 427/240; 427/430.1

[58] Field of Search ..... 427/226, 240, 430.1

[56] References Cited

U.S. PATENT DOCUMENTS

| | | | |
|---|---|---|---|
| 3,585,021 | 6/1971 | Geissler | 71/34 |
| 3,991,108 | 11/1976 | Jordan | 260/544 |
| 4,068,128 | 1/1978 | Chenot et al. | 250/483 |
| 4,157,378 | 6/1979 | Tomlinson et al. | 423/301 |
| 4,569,833 | 2/1986 | Gortsema | 423/305 |
| 4,579,594 | 4/1986 | Nanao et al. | 106/287.24 |
| 4,584,280 | 4/1986 | Nanao et al. | 501/80 |
| 4,622,310 | 11/1986 | Iacobucci | 502/208 |
| 4,668,299 | 5/1987 | Nanao et al. | 106/309 |
| 4,684,511 | 8/1987 | Gortsema et al. | 423/305 |
| 4,687,675 | 8/1987 | Nakano et al. | 427/2 |
| 4,701,314 | 10/1987 | David | 423/311 |
| 4,794,023 | 12/1988 | Shimamune et al. | 427/350 |
| 4,911,953 | 3/1990 | Hosonuma et al. | 427/226 |
| 4,975,299 | 12/1990 | Mir | 427/226 |

OTHER PUBLICATIONS

"Solution Deposited Metal Phosphate Coatings", R. K. Rothon, pp. 149–153 (1981).

"Spatitique Par Double Decomposition", M. Freche, R. Marancho, G. Constant, pp. 549–559 (1985).

"Hydrothermal Synthesis of Hydroxyapatite from Calcium Acetate and Triethyl Phosphate", Takeo Hattori et al., pp. 426–428, 1988.

*Primary Examiner*—Janyce Bell

*Attorney, Agent, or Firm*—Paul A. Leipold

[57] ABSTRACT

The invention is generally accomplished by mixing non-phosphorous containing metal coordination complexes and phosphorous coordination complexes, forming a coating of the mixture on a substrate and heating the mixture to recover a thin film coating of metal phosphate. The metal coordination complexes and phosphorous coordination complexes are defined as metal-ligand compounds where the ligand is thermally separable. The preferred ligands are carboxylates, alcoholates, and acetylacetonates. The heating decomposes the metal phosphate precursor coating materials to yield a metal phosphate. The phosphorous coordination complex may comprise an alkyl phosphate, arylphosphate, or a carboxylate substituted alkyl or aryl phosphate. The substituting carboxylic acids may be pure, such as 2-ethylhexanoic acid, mixtures of acids, such as neodecanoic acid, and naturally occurring acids, such as rosin (abietic acid). The metal coordination complex may be a metal carboxylate, a carboxylate substituted alkoxide, or carboxylate substituted acetylacetonate. Typical metals are the alkali metals, alkaline earths, titanium, zirconium, and aluminum.

17 Claims, No Drawings

THIN FILMS OF METAL PHOSPHATES AND THE METHOD OF THEIR FORMATION

FIELD OF THE INVENTION

The invention relates to a method of providing a coat or film of metal phosphate on a substrate. It particularly relates to the decomposition of metal carboxylates in the presence of phosphorous coordination complexes or metal alkoxides.

PRIOR ART

Coatings of metal phosphates generally have been formed from finely divided glass powders, pastes and cements. Formation of metal phosphate coatings by these methods requires first the formation of a powder, then a blending, coating and firing step to achieve the coat or film layer on a substrate.

Metal phosphate coatings are desirable for use in a variety of structures. The coats are useful both in the amorphous and crystalline form. In their crystalline form they are useful as molecular sieves, electro-optic materials, ion exchangers, non-linear optical materials, solid electrolyte material, catalytic substrates, as well as catalysts. In their amorphous form they are useful as wear-resistant surfaces.

U.S. Pat. No. 4,701,314 to David and U.S. Pat. No. 4,622,310 to Iacobucci disclose methods of making metal phosphate powders by reacting a metal alkoxide in an organic solvent with a phosphoric acid solution. These materials are reacted to form the metal phosphate and then fired to drive off the solvent and recover the powder. These materials are not suitable to form a coating, rather than powders, as there will be phase separation after reaction of the components.

In an article by Freche et al in ANN. CHIM. FR., 1985, 10 pp. 549–559 the reaction of calcium acetate with ammonium phosphate is disclosed as a method of producing the calcium phosphate. However, the process of Freche et al is limited to water as a solvent.

Rothon in an article in Thin Solid Films, 77 (1981) pp. 149–153 discloses solution deposited metal phosphate coatings by reaction exchange of an inorganic aluminum salt and phosphoric acid. This method of formation of phosphate coatings has the disadvantage that it cannot easily be extended to metals other than the aluminum disclosed therein. Further, it involves the utilization of hazardous materials and the process can only produce polycrystalline films.

Hattori et al in an article In Advanced Ceramics, Vol. 3, No. 4, (1988) pp. 426–428 discloses a hydrothermal process in which the metal phosphate is formed at high pressure. The disadvantage of this process is the use of high pressure, as well as the inability of the process to form anything other than grains of the metal phosphate.

Therefore, there remains a need for an easy to perform process of producing films of metal phosphates on a substrate. There is particular need for a method of forming films by casting or dipping such that irregular shapes may be coated. Further, there is a need for processes that do not require first formation of metal phosphate powders prior to the formulation of these powders to form coatings of metal phosphates on a substrate.

THE INVENTION

An object of this invention is to overcome disadvantages of prior methods of forming metal phosphates on a substrate.

Another object of the invention is to form improved amorphous coating films and improved crystalline coating films of metal phosphates.

These and other objects of the invention are generally accomplished by mixing non-phosphorous containing metal coordination complexes and phosphorous coordination complexes, forming a coating of the mixture on a substrate and heating the mixture to recover a thin film coating of metal phosphate. The metal coordination complexes and phosphorous coordination complexes are defined as metal-ligand compounds where the ligand is thermally separable. The preferred ligands are carboxylates, alcoholates, and acetylacetonates. The heating decomposes the metal phosphate precursor coating materials to yield a metal phosphate. The phosphorous coordination complex may comprise an alkyl phosphate, arylphosphate, or a carboxylate substituted alkyl or aryl phosphate. The substituting carboxylic acids may be pure, such as 2-ethylhexanoic acid, mixtures of acids, such as neodecanoic acid, and naturally occurring acids, such as rosin (abietic acid). The metal coordination complex may be a metal carboxylate, a carboxylate substituted alkoxide, or carboxylate substituted acetylacetonate. Typical metals include but are not limited to alkali metals, alkaline earths, titanium, zirconium, and aluminum.

MODES OF PERFORMING THE INVENTION

The invention has numerous advantages over prior processes of forming metal phosphates as films or coatings on a substrate. The materials may be formed either in the amorphous or crystalline phase based on the thermal treatment. Further, the process does not require first the formation of a metal phosphate powder and then of casting and firing. The process further does not require control of the atmosphere or high pressure. The process allows formation of metal phosphate coatings or irregular shapes not possible to coat by vapor deposition. The process also allows formation of uniform multimetal phosphates and blends of metal phosphates that cannot be easily formed by the vapor deposition techniques. By depositing multiple layers it is possible to adjust the thickness of the films and to produce layers of varying composition. These and other advantages will be apparent from the detailed description below.

The invention is generally performed by dissolving the non-phosphorous containing metal-coordination complex in a solvent and adding a phosphorous coordination complex to the solution. Metal-coordination complexes are defined as metal ligand compounds where the ligand is thermally separable. Phosphorous coordination complexes are defined as phosphorous-oxygen compounds with ligands which volatilizes upon thermal treatment. The pyrolysis products of the phosphorous coordination complex interact with non-phosphorous containing metal-coordination complex compounds to form metal-phosphates and mixed metal phosphates when they interact with mixed precursor metal-phosphate compounds. After mixing to obtain a homogeneous solution the material is coated onto a substrate. The coating is then heated to evaporate solvents, and to decompose the coordination complex and yield the metal phosphate. The resulting layer may be either amorphous or crystalline depending upon the thermal treatment. Crystalline materials form at the higher temperatures for most materials. A typical heating temperature utilized to yield a crystalline coating film layer in this process is about 800° C. for aluminum phosphate. The coating methods utilized in the invention may be any conventional method such as spin coating, spray coating, or dip coating. The substrate may be any material in which a phosphate coating is desired and which has the ability to survive the temperatures required for decomposition of the coordination complexes. Typical of such substrate materials are fused quartz, silicon, aluminum oxide, and magnesium oxide.

The process may be performed with any non-phosphorous containing metal coordination complex that results in formation of metal phosphate when decomposed after being mixed with a phosphorous coordination complex. Typical of such metal coordination complexes materials are carboxylates of the transition elements, alkali metals, alkaline earths, and lanthanides. Preferred metal resinates are carboxylates of the Group 1 metals lithium, sodium and potassium, and the Group 2 metals magnesium, calcium, strontium, and barium. The nature of the product after heating is determined by their free energy of formation. Thus metal phosphates form when their free energy of formation is higher than the free energy of formation of the corresponding oxide.

The process may be performed with any phosphorous coordination complex that when combined with the metal coordination complexes and solvent will result in a metal phosphate coating after heating. Suitable for use in the process are the alkyl and aryl phosphates, and carboxylate substituted alkyl and aryl aliphatic phosphorous compounds. Preferred for the process are cresyl phosphate and tri-ethyl phosphate. These materials are readily soluble in conventional solvents and result in homogeneous solutions and coatings that after heating form uniform metal phosphate layers.

The addition of fluorinated carboxylic acid, such as heptafluorobutyric acid ($C_4F_7O_2H$), or other fluorinating agent, such as fluorinated alcohol or fluorinated acetylacetonate with the non-phosphorous containing metal coordination complex and the phosphorous coordination complex will result in the formation of metal fluorophosphates if they have a favorable energy of formation compared with the metal phosphate.

The heating of the substrate onto which the metal phosphate precursor layer has been formed may be to any temperature that results in the decomposition of the precursor layer to result in the pure metal phosphate. Heating temperature typically is between about 550° C. and 800° C. for crystallization and may be at any rate that does not cause disruption of the layer as decomposition takes place. A preferred heating rate is about 50° C./min. The temperature range for the preferred combination of chelated aluminum ethoxide and cresyl phosphate is to about 500° C. for an amorphous layer and to about 800° C. for formation of a crystalline layer.

The solvent, to dissolve the metal carboxylate or other coordination complex, may be any solvent that does not react, in a disruptive manner such as forming a precipitate or a gel with the metal carboxylate or the phosphorus containing agent. Typical of such solvents are benzene, toluene, xylene, and butanol. A preferred solvent is toluene as it is low in cost, low health hazard, and offers desirable coating advantages due to its surface tension and viscosity of casting liquids formed. The solvent utilized must be able to dissolve the metal coordination complexes, such as 2-ethylhexanoates, neodecanoates, and carboxylate substituted alkoxides.

The coating technique utilized to form a layer of the casting liquid may be anything that will give a thin coat on a particular substrate. These include spin coating, spraying, doctor blade coating, and curtain coating. In spin coating a liquid is applied to a substrate which is then spun at a high rate of rpms such as 6K. In dip coating the substrate is dipped into liquid and allowed to drain prior to heating. Spin coating results in very uniform thin film coatings.

The substrate onto which the casting solution is placed may be any substrate on which a metal phosphate coat would be useful. The material must be able to withstand the decomposition temperatures, such as 500° C., that are used in forming the metal phosphates of the invention. Among suitable substrates are aluminum oxide, quartz, magnesium oxides, and silicon. The coatings are between about 500 to over 20,000 angstroms thick depending on the number of coatings.

The following examples are intended to be illustrative and not exhaustive of techniques in accordance with the invention. Parts and percentages are by weight unless otherwise indicated.

METAL COORDINATION COMPLEX FORMATION

The preparation of resinate generally is carried out by one of the following processes:

1) Fusion

In this type of reaction a metal oxide, hydroxide, carbonate, or salt reacts with a carboxylic acid to form a metal carboxylate.

$$MO + 2RCOOH \rightarrow M(OOCR)_2 + H_2O$$

where RCOOH is a carboxylic acid, and MO is a divalent metal oxide.

2) Metathesis

In this type of reaction one exchanges either completely or partially a ligand in a material such as a metal alkoxide (or alcoholate) or a $\beta$-diketonate by a carboxylic group for example:

$$M(OR')_2 + xRCOOH \rightarrow M(OR')_{2-x}(OOCR)_x + R'OH$$

$$M(AcAc)_2 + xRCOOH \rightarrow M(AaAc)_{2-x}(OOCR)_{x+x} \cdot AcAcH$$

Following preparation the precursors are separated, concentrated, and assayed.

Listed below is the preparation of some non-phosphorous containing metal-ligand compounds, and a description of the phosphorous containing compounds and their derivatives:

TITANIUM COORDINATION COMPLEX (A)

Combine 1 part by molar ratio of titanium tetrabutoxide, 4 parts neodecanoic acid. Heating to about 100° C. with mixing is carried out with collection of butyl alcohol driven off until close to 3-moles of alcohol are removed. Thermogravimetric analysis (TGA) indicates the residue is 8.91% $TiO_2$.

POTASSIUM-COORDINATION COMPLEX (B)

32.7 g neodecanoic acid
10.0 g KOH 87%
25.0 g toluene
5.0 g xylenes

All the above ingredients are mixed with the KOH slurry in toluene. Heating with stirring was carried out to just before the reflux point. The reaction is exothermic and is characterized by bubbling. When this is completed, molecular sieves are added to remove water and heating is continued with stirring to just below the reflux point for an additional one-half hour. The resulting potassium concentration after filtering is 7.32% K.

CALCIUM COORDINATION COMPLEX (C)

7.4 g $Ca(OH)_2$
30.0 g 2-ethylhexanoic acid
Toluene

Mix 20 ml toluene and acid heat with stirring to point just below boiling. To this mixture add a slurry made of the calcium hydroxide and 20 ml toluene. The slurry is added slowly to permit the gradual formation and evaporation of water vapor. TGA results show a composition of 3.27% Ca.

ALUMINUM COORDINATION COMPLEX (D)

2.16 g aluminum t-butoxide
35 g large excess ethylacetoacetate
Toluene

Mix the above materials and reflux for 2 hours. Temperature is defined by reflux condition. The temperature is increased during the last five minutes of heating until slight coloring occurs. Particulate matter is settled and filtered through a Büchner funnel. A brownish clear liquid is obtained and concentrated by distillation ~100° C. under reduced pressure. TGA results indicate 4.29% $Al_2O_3$.

ZIRCONIUM COORDINATION COMPLEX RESINATE (E)

10.5 g Zr isopropoxide
22.5 g neodecanoic

Toluene is added as needed (~50 ml) and the solution is refluxed for about 2 hours in order to exchange isopropoxide groups and to remove them by evaporation. The resulting compound is filtered while hot. TGA shows 3.52% Zr.

PHOSPHORUS COORDINATION COMPLEX (1) Phosphorus Coordination Complexes (Engelhard 1-38241)

The resinate composition is a phenyl phosphate.

(2) 5.98 g cresyl phosphate (Eastman Chemicals No. T4420)

5.12 g rosin
8.5 g toluene

Combine ingredients and warm up gently until rosin is dissolved.

(3) Triethyl Phosphate (Eastman Chemicals No. 4662)

| | | |
|---|---|---|
| (4) | 4.65 g | triethylphosphate 4662 |
| | 7.9 g | rosin |
| | 8.7 g | xylenes |

Combine the ingredients and warm up until rosin is dissolved.

In the examples below, unless otherwise stated, amorphous thin films were produced by dripping about ½ ml of the mixture over a substrate, typically fused quartz, and spin coating at 6KRPM for about 30–60 seconds. This was followed by drying the substrate and wet film and decomposition on a hot stage.

When crystalline films were desired, the substrate and amorphous thin films were thermally treated until crystallization was effected.

EXAMPLES

Example 1

Titanium Phosphate 1.49 g titanium coordination complex (Engelhard No. 9428). Lot M-11573.
2.10 g phosphorus coordination complex (Engelhard No. 15). Lot F-33241 (#1).

An aliquot of the sample was decomposed in a crucible on a hot plate until no further decomposition was evident. Following this treatment the resulting powder was thermally treated in a furnace held at 1000° C. The residue is identified at $TiP_2O_7$ by X-ray diffraction.

Example 2

Titanium Phosphate 5.03 g Ti-resinate (Engelhard No. 9428). Composition is 7.2% titanium.
5.44 g tricresylphosphate The procedure of Example 1 is repeated substituting the above ingredients. $TiP_2O_7$ is obtained in the crystalline state after treatment at 1000° C. for 16 hours.

Example 3

Zirconium Phosphate 2.61 g Zr-isopropoxide (E)
1.85 g tricresyl phosphate
2.00 g toluene The procedure of Example 1 is repeated substituting the above ingredients. After decomposing the mixture, $ZrP_2O_2$ is formed in the crystalline state at 1100° C.

Example 4

Potassium Phosphate 0.94 g potassium coordination complex (B)
1.47 g phosphorus coordination complex resinate (#4)

The procedure of Example 1 is repeated substituting the above ingredients. After decomposition and thermal treatment to 900° C. for two hours, potassium phosphate is identified by X-ray diffraction.

Example 5

Calcium Phosphate 3.48 g Ca-coordination complex (Engelhard 772786)
0.93 g triethyl phosphate (#3)

0.89 g neodecanoic
2.0 g toluene

The procedure of Example 1 is repeated substituting the above ingredients. Powder film obtained is thermally treated to temperatures of about 800° C. for one hour. The resulting powder is identified as calcium phosphate.

Example 6

Calcium Phosphate 4.47 g calcium coordination complex (C) composition 3.27%
1.63 g cresyl phosphate excess (#2)

Three coatings were deposited onto a fused quartz substrate, with hot stage drying and decomposition after each coat was applied. This was followed by treatment in a furnace at 900° C. for one hour in order to obtain a polycrystalline film.

Example 7

Potassium Phosphate 2.25 g K-neodecanoate coordination complex (B) composition 7.32% K
1.63 g cresyl phosphate excess (#2)

The procedure of Example 1 is repeated substituting the above ingredients. After decomposition and thermal treatment to 900° C., potassium phosphate is identified by X-ray diffraction.

Example 8

Potassium Titanium Phosphate 1.09 g K coordination complex (B) 7.32% K
1.80 g Ti coordination complex 5.35% Ti (A)
0.80 g Cresyl phosphate (#2)

The procedure of Example 1 is repeated substituting the above ingredients. A portion of the thoroughly mixed liquid prior to spin-coating is decomposed in a crucible and the powder obtained is treated at 1000° C. for 3½ hours. The x-ray spectrum identifies the powder as potassium-titanium-phosphate powder.

Example 9

Aluminum Phosphate 1.20 g Al coordination complex (D) 4.29% $Al_2O_3$
0.30 g excess cresyl phosphate (#2)

The procedure of Example 1 is repeated substituting the above ingredients. The film was treated at 1000° C. where crystallization occurred to form polycrystalline aluminum phosphate film.

Example 10

Calcium Fluorophosphate 0.85 g Ca-coordination complex Engelhard composition 7.1% calcium lot# 36011
0.33 g tricresyl phosphate
0.02 g heptafluorobutyric acid
1.1 g xylenes The above materials are combined in a beaker. After slight heating, the mixture is stirred vigorously. Decomposition of a portion of it on a hot plate and treatment for ½ hours at 900° C. gave a powder later identified by X-ray diffraction as fluoroapatite.

The invention has been described in detail with particular reference to preferred embodiments thereof, but it will be understood that variations and modifications can be effected within the spirit and scope of the invention.

What is claimed is:

1. A method of formation of a layer of metal phosphate comprising mixing non-phosphorous containing metal coordination complexes and phosphorous coordination complexes, coating the mixture onto a substrate to form a metal phosphate precursor layer, and heating the precursor layer to form a metal phosphate layer wherein said metal phosphate comprises phosphates of at least one member of the group consisting of lithium, sodium, potassium, magnesium, strontium, and barium.

2. The method of claim 1 wherein said heating decomposes said precursor layer to yield said metal phosphate.

3. The method of claim 1 wherein said metal coordination complexes comprise metal carboxylates.

4. The method of claim 1 wherein said phosphorous coordination complexes are selected from the group consisting of cresyl phosphate, tri-ethyl phosphate and mixtures thereof.

5. The method of claim 1 wherein said coordination complexes comprise an alkyl phosphate or aryl phosphates.

6. The method of claim 3 wherein said metal carboxylate is selected from at least one of carboxylates of lithium, sodium, potassium, magnesium, calcium, strontium and barium.

7. A method of forming metal phosphates comprising mixing non-phosphorous containing metal coordination complexes, a fluorinating agent, and phosphorous coordination complexes, and heating to decompose the mixture, and form metal fluorophosphate.

8. The method of claim 7 wherein said metal coordination complexes comprise carboxylates of the transition elements, alkali metals, and alkaline earth metals.

9. The method of claim 7 wherein said metal phosphate is a powder.

10. The method of claim 7 wherein after mixing, said mixture is coated on a high temperature substrate prior to heating.

11. The method of claim 10 wherein said substrate has an irregular surface.

12. The method of claim 11 wherein said irregular surface is coated by dip coating.

13. The method of claim 1 wherein said mixture is coated by spin coating.

14. A method of forming metal phosphates comprising mixing non-phosphorous containing metal coordination complexes and phosphorous coordination complexes, and heating to decompose the mixture, and form metal phosphate, wherein said metal coordination complexes comprise metal salts of the oxidation or polymerization products of the terpenses.

15. The method of claim 7 wherein said metal coordination complexes comprise carboxylates of the transition elements, alkali metals, and alkaline earth metals.

16. The method of claim 7 wherein said phosphorous coordination complexes comprise the alkyl phosphates, aryl phosphates, and carboxylate substituted alkyl and aryl phosphates.

17. The method of claim 14 wherein after mixing, said mixture is coated on a high temperature irregular substrate prior to heating.

* * * * *

UNITED STATES PATENT AND TRADEMARK OFFICE

CERTIFICATE OF CORRECTION

PATENT NO. : 5,073,410

DATED : December 17, 1991

INVENTOR(S) : Gustavo R. Paz-Pujalt

It is certified that error appears in the above-indentified patent and that said Letters Patent is hereby corrected as shown below:

Column 8, line 58: "terpenses" should read --terpenes--.

Signed and Sealed this

Fourteenth Day of September, 1993

Bruce Lehman

*Attest:*

BRUCE LEHMAN

*Attesting Officer*

*Commissioner of Patents and Trademarks*